US010808730B2

(12) United States Patent
Müller et al.

(10) Patent No.: US 10,808,730 B2
(45) Date of Patent: Oct. 20, 2020

(54) PUMPING SYSTEM FOR GENERATING A VACUUM AND METHOD FOR PUMPING BY MEANS OF THIS PUMPING SYSTEM

(71) Applicant: Ateliers Busch SA, Chevenez (CH)

(72) Inventors: Didier Müller, Delémont (CH); Jean-Eric Larcher, Delle (FR); Théodore Iltchev, Grandvillars (FR)

(73) Assignee: Ateliers Busch SA, Chevenez (CH)

( * ) Notice: Subject to any disclaimer, the term of this patent is extended or adjusted under 35 U.S.C. 154(b) by 508 days.

(21) Appl. No.: 15/513,574

(22) PCT Filed: Oct. 2, 2014

(86) PCT No.: PCT/EP2014/071197
§ 371 (c)(1),
(2) Date: Mar. 23, 2017

(87) PCT Pub. No.: WO2016/050313
PCT Pub. Date: Apr. 7, 2016

(65) Prior Publication Data

US 2017/0284394 A1 Oct. 5, 2017

(51) Int. Cl.
*F04F 5/20* (2006.01)
*F04B 37/14* (2006.01)
(Continued)

(52) U.S. Cl.
CPC ..... *F04F 5/20* (2013.01); *F04B 37/14* (2013.01); *F04B 41/06* (2013.01); *F04C 25/02* (2013.01); *F04C 28/02* (2013.01); *F04D 19/046* (2013.01)

(58) Field of Classification Search
CPC ..... F04C 25/02; F04C 28/02; F04B 37/14; F04B 41/06; F04F 5/20; F04D 19/046
See application file for complete search history.

(56) References Cited

U.S. PATENT DOCUMENTS 6,589,023 B2 * 7/2003 Royce ..... F04B 37/14 417/2
6,644,931 B2 * 11/2003 Puech ..... F04B 37/14 417/199.1
(Continued)

FOREIGN PATENT DOCUMENTS

DE 3842886 A1 7/1989
DE 8816875 U1 7/1989
(Continued)

OTHER PUBLICATIONS

Machine Translation of DE 102012220442.*
International Search Report for PCT/EP2017/071197, dated Mar. 9, 2015, 12 pages.

*Primary Examiner* — Christopher S Bobish
(74) *Attorney, Agent, or Firm* — Praedcere Law

(57) ABSTRACT

The present invention relates to a pumping system to generate a vacuum (SP), comprising a main vacuum pump which is a claw pump (3) having a gas suction inlet (2) connected to a vacuum chamber (1) and a gas discharge outlet (4) leading into a gas evacuation conduit (5) in the direction of a gas exhaust outlet (8) outside the pumping system. The pumping system comprises a non-return valve (6) positioned between the gas discharge outlet (4) and the gas exhaust outlet (8), and an auxiliary vacuum pump (7) connected in parallel to the non-return valve. In a pumping method by means of this pumping system (SP), the main vacuum pump (3) is started up in order to pump the gases contained in the vacuum chamber (1) and to discharge these gases through its gas discharge outlet (4), simultaneously to which the auxiliary vacuum pump (7) is started up. Moreover the auxiliary vacuum pump (7) continues to pump all the while that the main vacuum pump (3) pumps the gases contained in the vacuum chamber (1) and/or all the while
(Continued)

that the main vacuum pump (3) maintains a defined pressure in the vacuum chamber (1).

9 Claims, 2 Drawing Sheets

(51) Int. Cl.

| | |
|---|---|
| ***F04B 41/06*** | (2006.01) |
| ***F04C 28/02*** | (2006.01) |
| ***F04D 19/04*** | (2006.01) |
| ***F04C 25/02*** | (2006.01) |

(56) References Cited

U.S. PATENT DOCUMENTS

| | | | | |
|---|---|---|---|---|
| 9,175,688 | B2 * | 11/2015 | Neel | F04C 23/005 |
| 9,558,969 | B2 * | 1/2017 | Seigeot | F04B 37/14 |
| 2002/0131870 | A1 * | 9/2002 | Puech | F04B 37/14 417/205 |
| 2003/0068233 | A1 * | 4/2003 | Royce | F04B 37/14 417/251 |
| 2006/0182638 | A1 * | 8/2006 | Ohmi | F04B 37/14 417/87 |
| 2008/0145238 | A1 * | 6/2008 | Shibayama | F04C 23/001 417/53 |
| 2009/0112370 | A1 * | 4/2009 | Tanaka | F04B 37/14 700/282 |
| 2011/0164992 | A1 * | 7/2011 | Shibayama | F04B 37/14 417/85 |
| 2012/0219443 | A1 * | 8/2012 | Neel | F04C 23/005 418/1 |
| 2015/0170938 | A1 * | 6/2015 | Seigeot | F04B 37/14 137/240 |

FOREIGN PATENT DOCUMENTS

| | | | |
|---|---|---|---|
| DE | 102012220442 | * | 4/2009 |
| EP | 1243795 | A1 | 9/2002 |
| JP | 2007100562 | A | 4/2007 |
| WO | 2014012896 | A2 | 1/2014 |

* cited by examiner

PUMPING SYSTEM FOR GENERATING A VACUUM AND METHOD FOR PUMPING BY MEANS OF THIS PUMPING SYSTEM

TECHNICAL FIELD OF THE INVENTION

The present invention relates to the field of vacuum technology. More precisely, it concerns a pumping system comprising at least one claw pump as well as a pumping method by means of this pumping system.

PRIOR ART

The general objectives to increase the performance of vacuum pumps, to reduce the costs of installations and the consumption of energy in industries such as the chemical industry, the pharmaceutical industry, the vacuum deposition industry, the semiconductor industry, etc., have led to significant developments in terms of performance, energy economy, bulkiness, in the drives, etc.

The state of the art shows that to improve the final vacuum, for example, supplementary stages must be added in vacuum pumps of the multi-stage Roots or multi-stage claw type. For the dry vacuum pumps of screw type additional turns of the screw must be provided and/or the rate of internal compression increased.

The speed of rotation of the pump plays a very important role by defining the operation of the pump during the different successive phases in the course of evacuation of the vacuum chamber. With the internal compression rates of the pumps available on the market (the order of magnitude of which is between 2 and 20, for example), the necessary electrical power in the first pumping phases, when the pressure at the suction end is between atmospheric pressure and about 100 mbar, that is to say during strong mass flow rate operation, will be very high if the speed of rotation of the pump cannot be reduced.

The common solution is to use a variable speed drive which makes possible reduction or increase of the speed and consequently of the power as a function of different criteria of the type pressure, maximal current, limit torque, temperature, etc. But during the periods of operation at reduced rotation speed there are decreases in flow rate at high pressure, the flow rate being proportional to the rotation speed. Also speed variation by variable speed drive entails additional costs and more bulkiness.

Another common solution is the use of valves of by-pass type at certain stages, in the multi-stage vacuum pumps of Roots or claw type, or at certain well defined places along the screw in the dry vacuum pumps of screw type. This solution requires numerous parts and presents problems of reliability.

The state of the art concerning the pumping systems which aim to improve the final vacuum and to increase the flow rate also comprise booster pumps of Roots type arranged upstream from main dry pumps. This type of systems is bulky, operates either with by-pass valves presenting problems of reliability or by employing means of measurement, control, adjustment or servo-control. However, these means of control, adjustment or servo-control must be controlled in an active way, which necessarily results in an increase in the number of components of the system, its complexity and its cost.

SUMMARY OF INVENTION

The present invention has as object to permit a better vacuum to be obtained (on the order of 0.0001 mbar) than that which a single claw pump is capable of generating in a vacuum chamber.

The present invention also has as object obtaining a draining or evacuation rate which is greater at low pressure than that which can be obtained with the aid of a single claw pump during a pumping to achieve a vacuum in a vacuum chamber.

The present invention likewise has as object to permit a reduction of the electrical energy necessary for the evacuation of a vacuum chamber and for maintaining the vacuum as well as to achieve a decrease in the temperature of the exit gas.

These objects of the present invention are achieved with the aid of a pumping system for generating a vacuum comprising a main vacuum pump which is a claw pump having a gas suction inlet connected to a vacuum chamber and gas discharge outlet leading into a gas evacuation conduit in the direction of a gas exhaust outlet outside the pumping system. The pumping system further comprises

- a non-return valve positioned between the gas discharge outlet and the gas exhaust outlet, and
- an auxiliary vacuum pump connected in parallel to the non-return valve.

The auxiliary vacuum pump can be of different types, in particular another claw pump, a dry pump of screw type, a pump of multi-stage Roots type, a diaphragm pump, a dry rotary vane pump, a lubricated rotary vane pump or also a gas ejector.

The invention likewise has as subject matter a pumping method by means of a pumping system such as previously defined. This method comprises steps in which:

- the main vacuum pump is started up in order to pump the gases contained in the vacuum chamber and to discharge these gases through its gas discharge outlet;
- simultaneously the auxiliary vacuum pump is started up; and
- the auxiliary vacuum pump continues to pump all the while that the main vacuum pump pumps the gases contained in the vacuum chamber and/or all the while that the main vacuum pump maintains a defined pressure in the vacuum chamber.

In the method according to the invention, the auxiliary pump is operated continuously all the while that the main claw vacuum pump evacuates the vacuum chamber, but also all the while that the main claw vacuum pump maintains a defined pressure (for example the final vacuum) in the chamber by evacuating the gases through its discharge end.

Thanks to the method according to the invention, the coupling of the main claw vacuum pump and of the auxiliary pump can be carried out without requiring specific measures or apparatuses (for example sensors for pressure, temperature, current, etc.), nor servo-controls, nor data management and without calculation. Consequently the pumping system suitable for implementing the pumping method according to the present invention can comprise only a minimal number of components, can have great simplicity and can cost considerably less compared with existing systems.

Thanks to the method according to the invention, the main claw vacuum pump can operate at a single constant speed, that of the power grid, or turn at variable speeds in accordance with its own mode of operation. Consequently, the complexity and the cost of the pumping system suitable for implementing the pumping method according to the present invention can be reduced even more.

By its nature, the auxiliary pump integrated in the pumping system can always operate according to the pumping method of the invention without being subject to mechanical damage. Its dimensioning is conditioned by a minimal energy consumption for the operation of the device. Its nominal flow rate is selected as a function of the volume of the evacuation conduit between the main claw vacuum pump and the non-return valve. This flow rate can be advantageously from 1/500 to 1/20 of the nominal flow rate of the main claw vacuum pump, but can also be less than or greater than these values, in particular from 1/500 to 1/10 or even from 1/500 to 1/5 of the nominal flow rate of the main vacuum pump.

The non-return valve, placed in the conduit downstream from the main claw vacuum pump, can be, for example, a standard commercially available element, but it is likewise imaginable to design an element dedicated to the specific application. It is dimensioned according to the nominal flow rate of the main claw vacuum pump. In particular, it is foreseen that the non-return valve closes when the pressure at the suction end of the main claw vacuum pump is between 500 mbar absolute and the final vacuum (for example 100 mbar).

According to still another variant, the auxiliary pump can be made of materials and/or with coatings having high chemical resistance to substances and gases commonly used in the semi-conductor industry.

The auxiliary pump is preferably of small size.

Preferably, according to the pumping method employing the pumping system according to the invention, the auxiliary vacuum pump always pumps in the volume between the gas discharge outlet of the main claw vacuum pump and the non-return valve.

According to another variant of the method of the present invention, to fulfil specific requirements, the actuation of the auxiliary vacuum pump is controlled in an "all or nothing" way. The control consists in measuring one or more parameters and following certain rules to actuate the auxiliary vacuum pump or to stop it. The parameters, provided by suitable sensors, are, for example, the current of the motor of the main claw vacuum pump, the temperature or the pressure of the gases at its exhaust end, i.e. in the space upstream from the non-return valve in the evacuation conduit, or a combination of these parameters.

The dimensioning of the auxiliary vacuum pump aims to achieve a minimal energy consumption of its motor. Its nominal flow rate is selected as a function of the flow rate of the main claw vacuum pump, but also taking into account the volume which the gas evacuation conduit delimits between the main vacuum pump and the non-return valve. This flow rate can be from 1/500 to 1/20 of the nominal flow rate of the main claw vacuum pump, but can also be less than or greater than these values.

Starting from a cycle of evacuation of the chamber, the pressure there is high, for example equal to the atmospheric pressure. Considering the compression in the main claw vacuum pump, the pressure of the gases discharged at its exit is higher than the atmospheric pressure (if the gases at the exit of the main pump are discharged directly into the atmosphere) or higher than the pressure at the inlet of another apparatus connected downstream. This causes the opening of the non-return valve.

When this non-return valve is open, the action of the auxiliary vacuum pump is felt very slightly since the pressure at its suction end is almost equal to that at its discharge end. On the other hand, when the non-return valve closes at a certain pressure (because the pressure in the chamber has dropped in the meantime), the action of the auxiliary vacuum pump causes a progressive reduction of the difference in pressure between the vacuum chamber and the evacuation conduit upstream from the valve.

The pressure at the exit of the main claw vacuum pump becomes that at the inlet of the auxiliary vacuum pump, that of its exit always being the pressure in the conduit after the non-return valve. The more the auxiliary vacuum pump pumps, the more the pressure at the exit of the main claw vacuum pump, in the space limited by the closed non-return valve, drops and consequently the difference in pressure between the chamber and the exit of the main claw vacuum pump decreases. This slight difference reduces the internal leaks in the main claw vacuum pump and causes a reduction of the pressure in the chamber, which improves the final vacuum.

In addition, the main claw vacuum pump consumes less and less energy for the compression and produces less and less compression heat.

On the other hand, it is also evident that the study of the mechanical concept seeks to reduce the space between the gas discharge outlet of the main claw vacuum pump and the non-return valve with the aim of being able to lower the pressure there more quickly.

BRIEF DESCRIPTION OF DRAWINGS

The features and the advantages of the present invention will appear with more details within the context of the description which follows with example embodiments, given by way of illustration and in a non-limiting way, with reference to the attached drawings.

DETAILED DESCRIPTION OF EMBODIMENTS OF THE INVENTION

Figure 1:
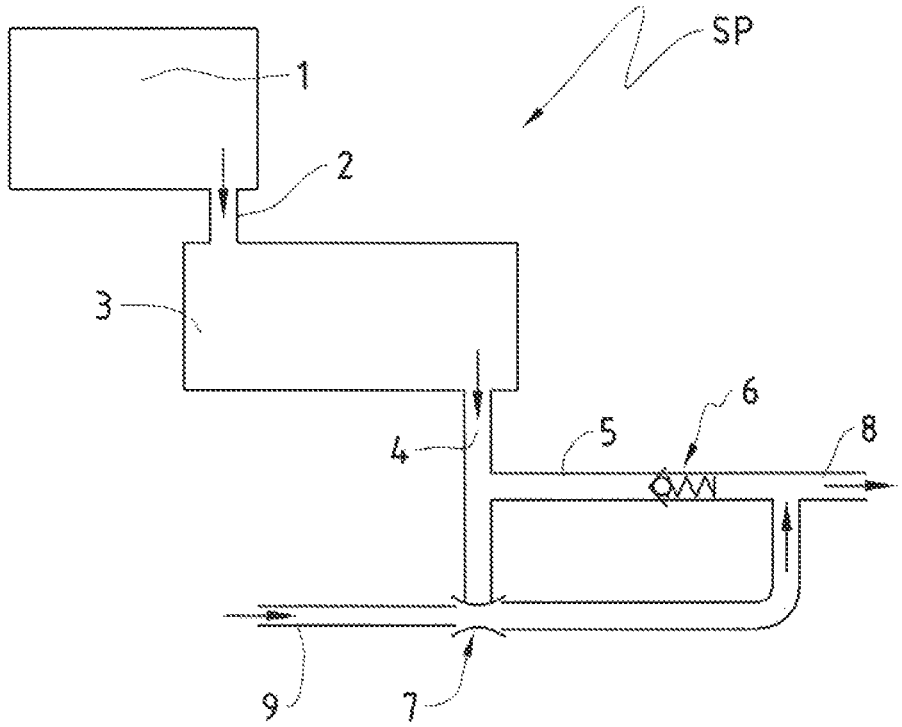
FIG. 1 represents in a diagrammatic way a pumping system suitable for implementation of a pumping method according to a first embodiment of the present disclosure.

FIG. 1 represents a pumping system SP for generating a vacuum, which is suitable for implementing a pumping method according to a first embodiment of the present invention.

This pumping system SP comprises a chamber 1, which is connected to the suction end 2 of a main vacuum pump constituted by a claw pump 3. The gas discharge outlet of the main claw vacuum pump 3 is connected to an evacuation conduit 5. A non-return discharge valve 6 is placed in the evacuation conduit 5, which, after this non-return valve, continues into the gas exit conduit 8. The non-return valve 6, when it is closed, permits the formation of a volume 4, contained between the gas discharge outlet of the main vacuum pump 3 and itself.

The pumping system SP also comprises the auxiliary vacuum pump 7, connected in parallel to the non-return valve 6. The suction end of the auxiliary vacuum pump is connected to the space 4 of the evacuation conduit 5 and its discharge end is connected to the conduit 8.

Already with the actuation of the main claw vacuum pump 3, the auxiliary vacuum pump 7 is itself actuated. The main claw vacuum pump 3 suctions the gases in the chamber 1 through the conduit 2 connected at its inlet and compresses them in order to discharge them subsequently at its exit in the evacuation conduit 5 through the non-return valve 6. When the closure pressure for the non-return valve 6 is reached, it closes. Starting from this moment the pumping of the auxiliary vacuum pump 7 makes the pressure in the space 4 drop progressively to the value of its pressure limit. In parallel, the power consumed by the main claw vacuum pump 3 decreases progressively. This takes place in a short time period, for example for a certain cycle in 5 to 10 seconds as a function of the relationship between the volume 4 and the nominal flow rate of the auxiliary vacuum pump 7, but can also last longer.

With a clever adjustment of the flow rate of the auxiliary vacuum pump 7 and of the closure pressure of the non-return valve 6 as a function of the flow rate of the main claw vacuum pump 3 and the volume of the chamber 1, it is moreover possible to reduce the time before the closure of the non-return valve 6 with respect to the duration of the evacuation cycle and thus reduce the quantity of energy consumed during this time of operation of the auxiliary pump 7, with the advantage of simplicity and of reliability of the system.

Figure 3:
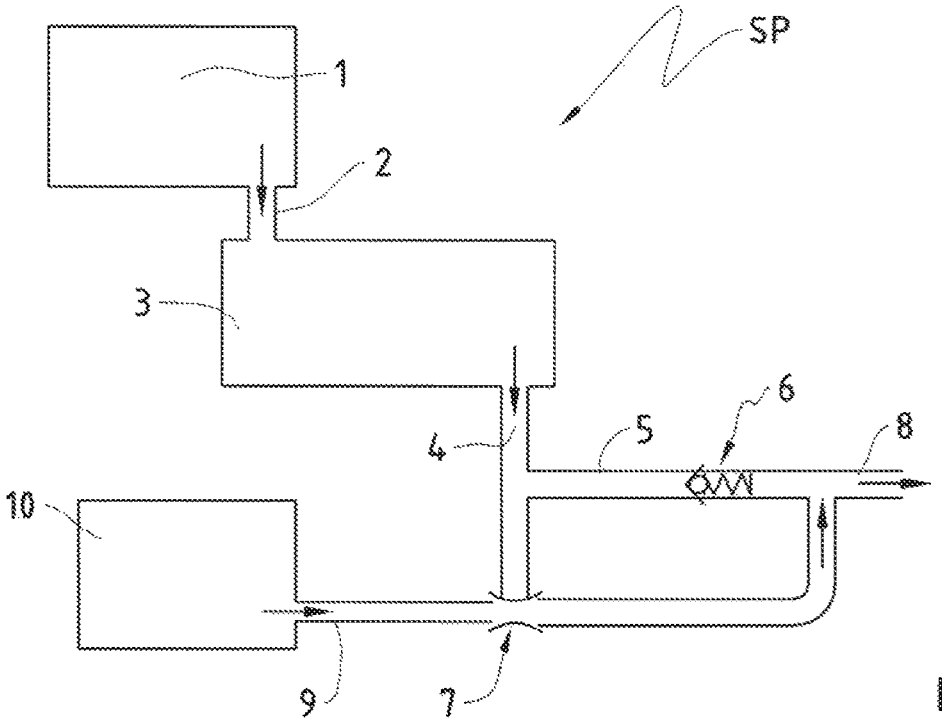
FIG. 3 represents in a diagrammatic way a pumping system suitable for implementation of a pumping method according to another embodiment of the present disclosure including a compressor feeding air to an ejector.
Figure 4:
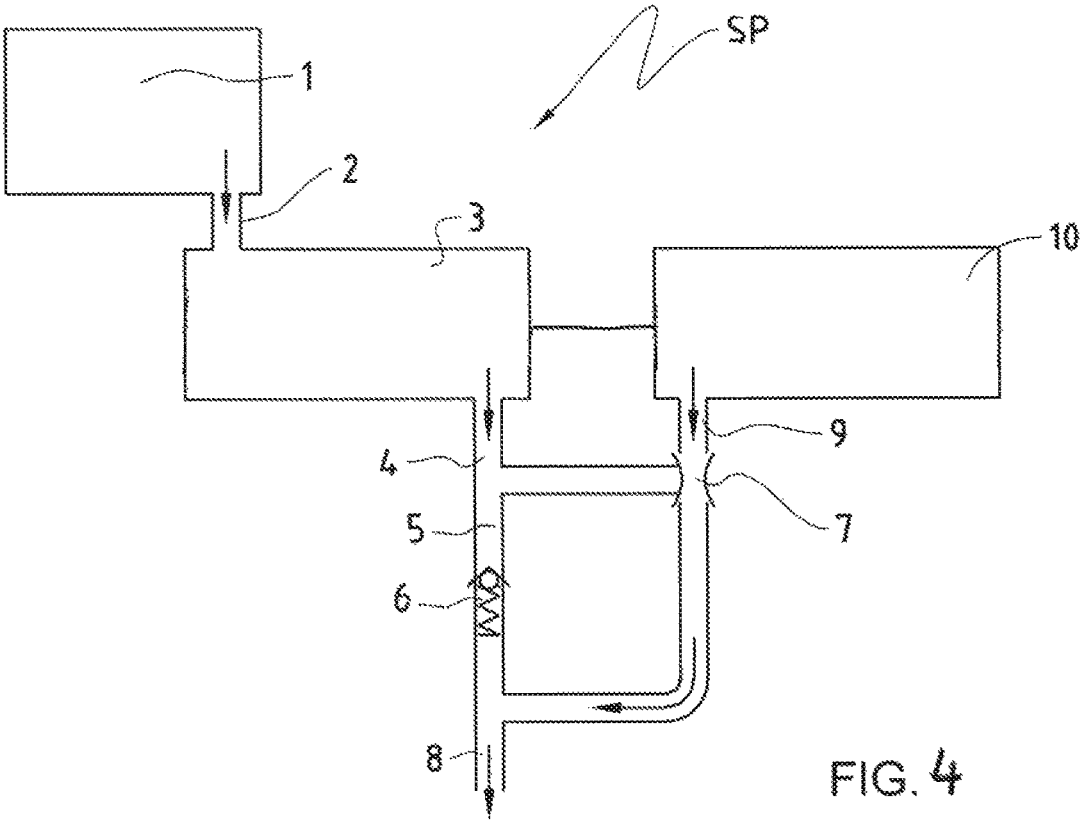
FIG. 4 represents in a diagrammatic way a pumping system suitable for implementation of a pumping method according to another embodiment of the present disclosure including a compressor powered by the main pump which feeds air to an ejector.

According to the different possibilities of combination, the auxiliary vacuum pump 7 can be another claw pump, a dry pump of screw type, a multi-stage Roots pump, a diaphragm pump, a dry rotary vane pump, a lubricated rotary vane pump or even an ejector. In the last case, the ejector can be a "simple" ejector in the sense that the flow rate of its propellant gas comes from a distribution network on the industrial site, or can be equipped with a compressor 10 which provides to the ejector the flow of propellant gas at the pressure necessary for its operation (FIGS. 3 and 4). More specifically, this compressor 10 can be driven by the main pump (FIG. 4) or, alternatively or in addition, in an autonomous way, independently of the main pump. This compressor can suction the atmospheric air or gases in the gas exit conduit after the non-return valve. The presence of such a compressor renders the system of pumps independent of a source of compressed gas, which can meet requirements of certain industrial environments.

Figure 2:
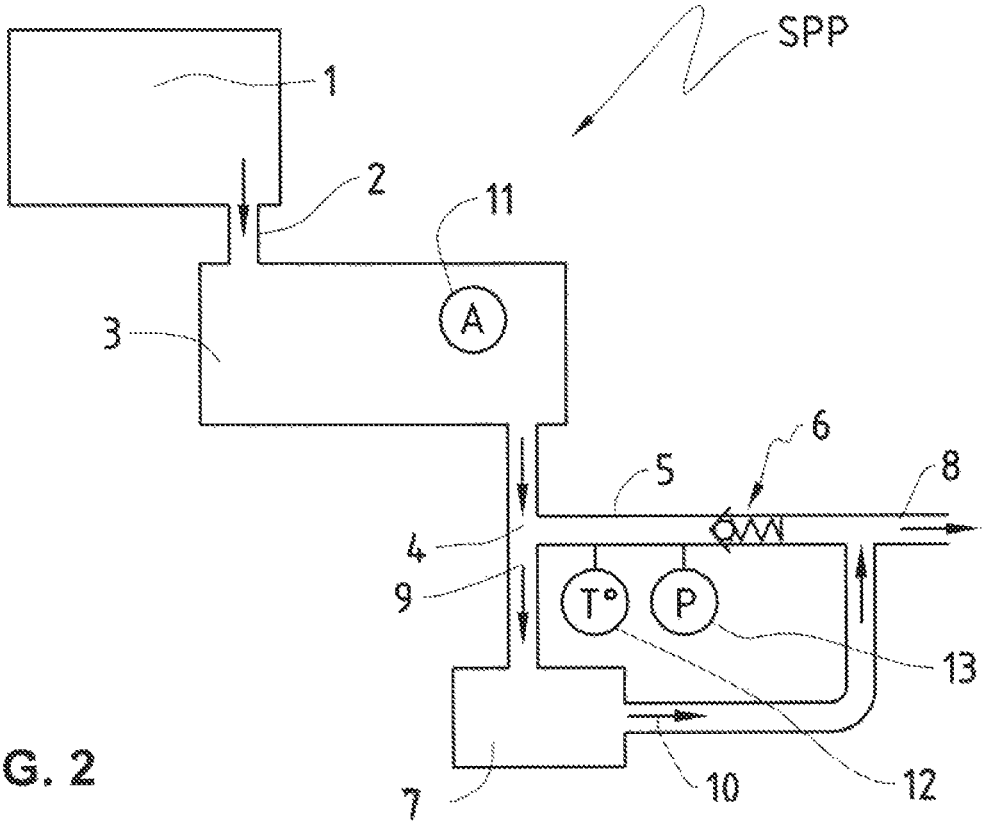
FIG. 2 represents a pumping system SPP suitable for implementation of a pumping method according to a second embodiment of the present invention.

FIG. 2 represents a pumping system SPP suitable for implementation of a pumping method according to a second embodiment of the present invention.

With respect to the system shown in FIG. 1, the system shown in FIG. 2 represents the controlled pumping system SPP, may further comprise suitable sensors 11, 12, 13 which check either the current of the motor (sensor 11) of the main claw vacuum pump 3, or the pressure (sensor 13) of the gases in the space of the exit conduit of the main claw vacuum pump, limited by the non-return valve 6, or the temperature (sensor 12 of the gases in the space of the exit conduit at the exit of the main claw vacuum pump, limited by the non-return valve 6, or a combination of these parameters. In effect, when the main claw vacuum pump 3 begins to pump the gases of the vacuum chamber 1, the parameters such as the current of its motor, the temperature and the pressure of the gases in the space of the exit conduit 4 begin to change and reach threshold values detected by the sensors. After a time lag, this causes the startup of the auxiliary vacuum pump 7. When these parameters return to the initial ranges (outside the set values), with a time lag the auxiliary vacuum pump is stopped.

In the second embodiment of the invention of FIG. 2, the auxiliary vacuum pump can also be of claw type, of dry screw type, multi-stage Roots type, diaphragm type, dry rotary vane type, lubricated rotary vane type, or an ejector (with or without compressor providing its propellant gas), as in the first embodiment of FIG. 1.

Although diverse embodiments have been described, it is well understood that it is not conceivable to identify in an exhaustive way all the possible embodiments. Of course replacing a described means with an equivalent means can be envisaged without departing from the scope of the present invention. All these modifications form part of the common knowledge of one skilled in the art in the field of vacuum technology.

The invention claimed is:

1. Pumping system for generating a vacuum, comprising a main vacuum pump having a gas suction inlet connected to a vacuum chamber and a gas discharge outlet leading into a gas evacuation conduit in the direction of a gas exhaust outlet outside the pumping system, wherein the pumping system comprises a non-return valve positioned between the gas discharge outlet and the gas exhaust outlet, and an auxiliary vacuum pump connected in parallel to said non-return valve, wherein said auxiliary vacuum pump comprises a discharge end which is connected downstream from said non-return valve to the gas exhaust outlet, wherein said auxiliary vacuum pump is an ejector; and a compressor driven by said main vacuum pump that provides flow of gas at a pressure suitable for operation of said ejector;

said main vacuum pump and said auxiliary vacuum pump are started simultaneously and said auxiliary vacuum pump operates all the while that said main vacuum pump operates and/or all the while that said main vacuum pump maintains a defined pressure in the vacuum chamber.

2. Pumping system according to claim 1, wherein nominal flow rate of said auxiliary vacuum pump is selected as a function of the inner volume of the gas evacuation conduit between said main vacuum pump and said non-return valve.

3. Pumping system according to claim 2, wherein said auxiliary vacuum pump is single-staged.

4. Pumping system according to claim 1, wherein the nominal flow rate of said auxiliary vacuum pump is from 1/500 to 1/5 of the nominal flow rate of said main vacuum pump.

5. Pumping system of claim 1 excluding a pressure sensor.

6. Pumping method by means of a pumping system, comprising providing a pumping system for generating a vacuum, comprising:

a main vacuum pump having a gas suction inlet connected to a vacuum chamber and a gas discharge outlet leading into a gas evacuation conduit in the direction of a gas exhaust outlet outside the pumping system;

a non-return valve positioned between the gas discharge outlet and the gas exhaust outlet;

an auxiliary vacuum pump connected in parallel to said non-return valve, wherein said auxiliary vacuum pump comprises a discharge end which is connected downstream from said non-return valve to said gas exhaust outlet, wherein said auxiliary vacuum pump is an ejector; and a compressor driven by said main pump that provides flow of gas at a pressure suitable for operation of said ejector;

starting up said main vacuum pump in order to pump the gases contained in the vacuum chamber and to discharge these gases through said gas discharge outlet and simultaneously starting up said auxiliary vacuum pump; and wherein said auxiliary vacuum pump continues to pump all the while that the said main vacuum pump pumps the gases contained in the vacuum chamber and/or all the while that said main vacuum pump maintains a defined pressure in the vacuum chamber.

7. Pumping method according to claim 6, wherein said auxiliary vacuum pump pumps at a flow rate on the order of 1/500 to 1/20 of the nominal flow rate of said main vacuum pump.

8. Pumping method according to claim 7, comprising closing said non-return valve when the pressure at the suction end of said main vacuum pump is less than 500 mbar absolute.

9. Pumping method of claim 6 excluding a pressure sensor.

* * * * *